US007170274B2

(12) United States Patent
Mukherjee et al.

(10) Patent No.: US 7,170,274 B2
(45) Date of Patent: Jan. 30, 2007

(54) TRIMMABLE BANDGAP VOLTAGE REFERENCE

(75) Inventors: Debanjan Mukherjee, San Jose, CA (US); Jishnu Bhattacharjee, San Jose, CA (US); Abhijit Phanse, Sunnyvale, CA (US)

(73) Assignee: Scintera Networks, Inc., San Jose, CA (US)

( * ) Notice: Subject to any disclaimer, the term of this patent is extended or adjusted under 35 U.S.C. 154(b) by 182 days.

(21) Appl. No.: 10/724,440

(22) Filed: Nov. 26, 2003

(65) Prior Publication Data

US 2005/0110476 A1 May 26, 2005

(51) Int. Cl.
*G05F 3/16* (2006.01)

(52) U.S. Cl. ..... 323/313

(58) Field of Classification Search ..... 323/312, 323/313, 314, 315, 316
See application file for complete search history.

(56) References Cited

U.S. PATENT DOCUMENTS 5,291,122 A * 3/1994 Audy ..... 323/313
6,501,256 B1 12/2002 Jaussi et al.
6,891,357 B2 * 5/2005 Camara et al. ..... 323/316

OTHER PUBLICATIONS

"A CMOS Bandgap Reference Circuit With Sub-I-V Operation," by Hironori Banba et al., IEEE Journal of Solid-State Circuits, vol. 34, No. 5, May 1999.

* cited by examiner

*Primary Examiner*—Adolf Berhane
(74) *Attorney, Agent, or Firm*—Jonathan W. Hallman; MacPherson Kwok Chen & Heid LLP

(57) ABSTRACT

A bandgap reference includes a current source providing a current that is proportional to the sum of a first voltage having a positive-to-absolute-temperature (PTAT) temperature dependency and a second voltage having a complementary-to-absolute-temperature (CTAT) dependency. The bandgap reference further includes a variable resistor comprising a fixed resistor that may be selectively combined with one or more of a plurality of selectable resistors, wherein the first voltage is inversely proportional to the resistance of the variable resistor.

17 Claims, 4 Drawing Sheets

TRIMMABLE BANDGAP VOLTAGE REFERENCE

FIELD OF INVENTION

This invention relates generally to bandgap voltage references, and more particularly to a trimmable bandgap voltage reference.

BACKGROUND

Bandgap voltage references provide a stable voltage reference by summing voltages that have opposing temperature dependencies. For example, the voltage across a forward-biased PN junction will decrease approximately 2 milli-volts per degree Celsius as the temperature of the PN junction is increased. Such a temperature dependency may be denoted as a complementary-to-absolute-temperature (CTAT) dependency. In contrast, the difference in base-to-emitter voltages ($\Delta V_{BE}$) between matched transistors operating at different current densities shows a positive-to-absolute-temperature (PTAT) dependency that is proportional to the thermal voltage $V_T$. The thermal voltage equals kT/q, where k is the Boltzmann constant, T is the absolute temperature in degrees Kelvin, and q is the magnitude of electronic charge. Thus, the thermal voltage will increase about 0.085 milli-volts per degree Celsius, giving it a PTAT temperature dependency. By proper scaling of the PTAT and CTAT voltages, a thermally stable voltage reference may be obtained.

A conventional bandgap reference 10 is shown in FIG. 1. Current source 20 generates a current I proportional to the thermal voltage. Thus, because current I increases with temperature, passing current I through a resistor of resistance R will generate a PTAT voltage equaling I*R. A diode D, which may comprise a diode-connected transistor, is in series with resistor R and is forward biased in response to current I to provide a CTAT voltage $V_{BE}$. Taking the output voltage $V_{out}$ from node A provides the sum of the CTAT and PTAT voltages. By choosing the value of R appropriately, $V_{out}$ will be thermally stable. In other words, $V_{out}$ may be made independent with respect to changes in temperature.

Although bandgap reference 10 may provide a thermally stable output voltage assuming a careful choice for resistance R, the reality is typically that some thermal variations will be observed in a certain percentage of devices during mass production. For example, the PTAT voltage depends upon the matching between two transistors, which may vary during production due to transistor dimension and doping variations. In addition, thermal variation may result from modeling inaccuracies. As a result, trimmable bandgap voltage references have been developed that include variable resistances. Through means such as switches, the resistances are varied to compensate for process inaccuracies so as to balance the PTAT and CTAT voltages. Although trimmable bandgap voltage references allow process inaccuracies to be addressed, these references often require an excessive number of adjustments and still suffer from mismatches.

Accordingly, there is a need in the art for improved trimmable bandgap voltage references that can provide an output voltage that is stable with respect to temperature changes without requiring an excessive number of adjustments or switches.

SUMMARY

In accordance with one aspect of the invention, a bandgap reference is provided having a first current source configured to provide a current that is proportional to the sum of a first voltage having a positive-to-absolute-temperature (PTAT) temperature dependency and a second voltage having a complementary-to-absolute-temperature (CTAT) dependency. The bandgap reference further includes a variable resistor including a first resistor and a plurality of second resistors, wherein each of the second resistors is adapted to be selectively combined in parallel with the first resistor, and wherein the second voltage is inversely proportional to the resistance of the variable resistor. Advantageously, the variable resistor requires relatively few resistors in the plurality of second resistors to provide a relatively broad dynamic range over which the resistance of the variable resistor may be varied to achieve a balance between the first and second voltages. In this fashion, should process variations or other affects upset the expected balance between the first and second voltages, the bandgap reference may still provide an output voltage that is stable across an operating temperature range through an appropriate resistance variation in the variable resistor.

DETAILED DESCRIPTION

Figure 1:
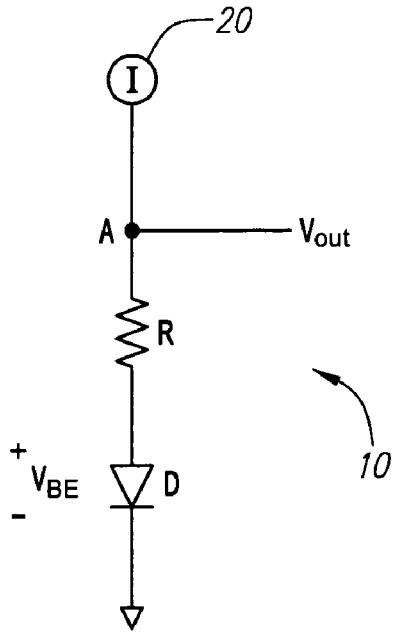
FIG. 1 (PRIOR ART)
FIG. 1 is a simplified schematic illustration of a conventional bandgap reference.
Figure 2:
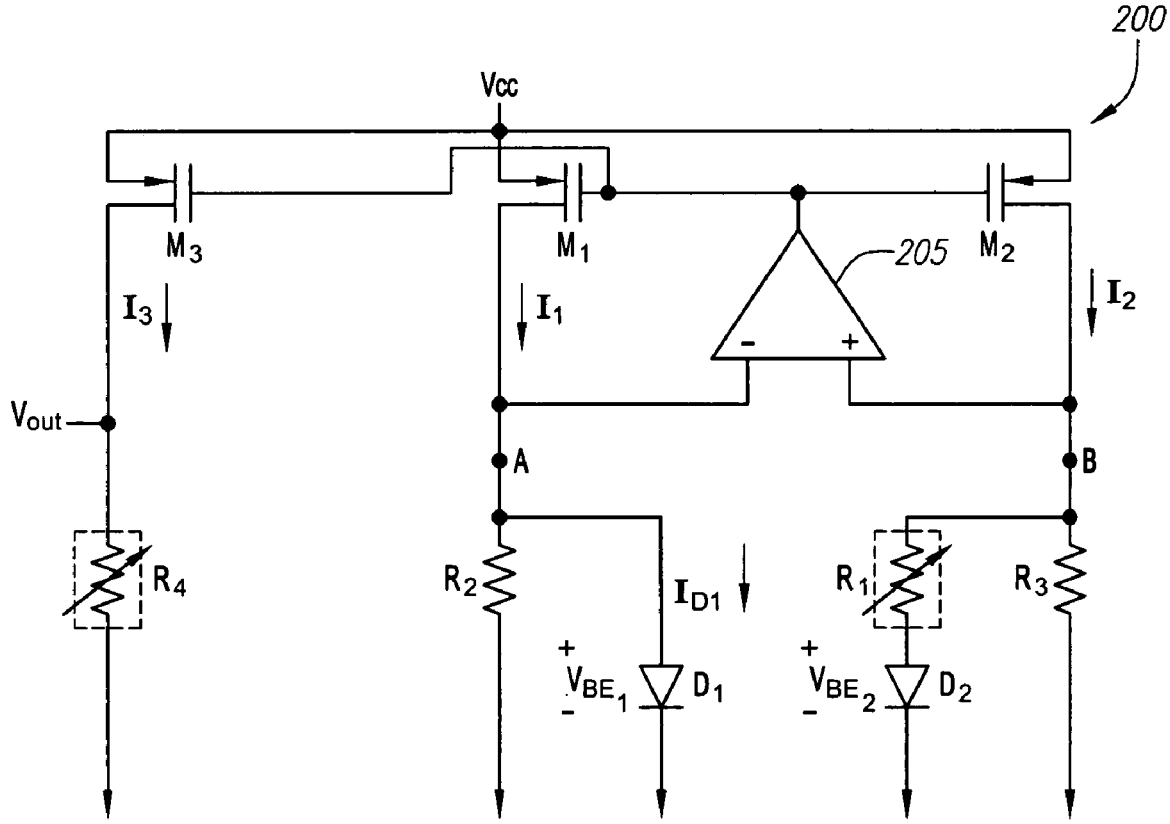
FIG. 2 is a schematic illustration of a bandgap reference according to one embodiment of the invention.

A bandgap reference 200 having an output voltage $V_{out}$ that depends upon a voltage having a positive-to-absolute-temperature (PTAT) dependency and upon a voltage having a complementary-to-absolute-temperature (CTAT) dependency is shown in FIG. 2. A resistor having a variable resistance $R_1$ determines the balance between the PTAT and CTAT voltages as will be explained further herein. A differential amplifier 205 maintains the same voltage at nodes A and B and provides the same gate voltages to matched PMOS transistors $M_1$, $M_2$, and $M_3$ (transistors $M_1$ through $M_3$ may also be constructed as NMOS transistors). Because matched transistors $M_1$ through $M_3$ each receives the same gate voltage, currents $I_1$, $I_2$, and $I_3$ are equal. The currents through a pair of matched resistors having equal resistances $R_2$ and $R_3$ must also be equal since the voltages at nodes A and B are kept equal by differential amplifier 205. A diode $D_1$ couples in parallel with resistance $R_2$ to node A. Similarly, a series combination of the variable resistance $R_1$ and diode $D_2$ couples in parallel with resistance $R_3$ to node B.

Note that the feedback from differential amplifier 205 is both negative and positive in that differential amplifier 205 receives the voltage from node A at its positive input and the voltage from node B at its negative input. If the voltage at node A is too high with respect to a desired operating voltage, differential amplifier 205 increases its output voltage so that the current through transistors M1 through M3 is reduced, thereby reducing the voltage across resistor $R_2$ to bring the voltage at node A down. Similarly, if the voltage at node B is too low, differential amplifier decreases its output voltage so that the current in transistors M1 through M3 is increased, thereby increasing the voltage across resistor $R_3$ to bring the voltage at node B up. In this fashion, equilibrium is reached such that the voltages of nodes A and B are kept substantially equal.

The cross-sectional area of diode $D_2$ is n times larger than that of diode $D_1$, where n is an arbitrary value. Both diodes $D_1$ and $D_2$ may be implemented using diode-connected transistors. It follows from the equality of currents $I_1$ and $I_2$ and the equality of the currents through resistances $R_2$ and $R_3$ that the current through diode $D_1$ and the current through diode $D_2$ must also be equal. Both diodes $D_1$ and $D_2$ may each comprise a diode-connected PNP or NPN bipolar junction transistor having a base-to-emitter voltage of $V_{BE1}$ and $V_{BE2}$, respectively.

These two voltages $V_{BE1}$ and $V_{BE2}$ may be used to derive the value of $I_1$ (and hence $I_2$ and $I_3$) as follows. Current $I_3$ must equal the sum of the current through resistance $R_2$, which equals $V_{BE1}/R_2$, and the current through diode $D_1$. Because the diode currents are the same, the current through diode $D_1$ equals the current through variable resistance $R_1$. In turn, the current through variable resistance $R_1$ equals $(V_{BE1} - V_{BE2}k)/R_1$. Thus, the currents $I_1$, $I_2$, and $I_3$ may be expressed as:

$$I_1=I_2=I_3=(1/R_2)*[V_{BE1}+\Delta V_{BE}*R_2/R_1] \quad \text{Eq.(1)}$$

where $\Delta V_{BE2} = V_{BE1} - V_{BE2}$. As discussed above, a voltage such as $V_{BE1}$ will have a CTAT dependency whereas a voltage such as $\Delta V_{BE}$ will have a PTAT dependency. In particular, the voltage $\Delta V_{BE}$ equals $V_T$ ln (n), which in turn equals (kT/q) * ln(n), where $V_T$ is the thermal voltage, k is Boltzmann's constant, n is the cross sectional ratio (area of $D_2$)/(area of $D_1$), and q is the electronic charge. Thus, the bracketed component in equation (1) depends upon the summation of a PTAT voltage and a CTAT voltage. By proper compensation of these PTAT and CTAT components, currents $I_1$ through $I_1$ may be made stable with respect to changes in temperature. The output voltage $V_{out}$, which depends upon the product of a variable resistance $R_4$ and current $I_3$, becomes:

$$V_{out}=(R_4/R_2)*[V_{BE1}+\Delta V_{BE}*R_2/R_1] \quad \text{Eq. (2)}$$

Thus, by varying the resistance $R_1$, the balance between the PTAT and CTAT voltage contributions may be changed to ensure that $V_{out}$ is stable with respect to changes in temperature. Similarly, by varying the resistance $R_4$, the output voltage level for $V_{out}$ may be changed. The variation of R1 will be discussed first.

Varying $R_1$ to Balance the PTAT and CTAT Voltage Contributions

From Equation (2), it may be seen that the contribution of the PTAT voltage $\Delta V_{BE}$ is proportional to the inverse of the variable $R_1$ resistance. Alternatively, given that the resistance $R_2$ is static, the contribution of the PTAT voltage may be viewed as proportional to the quantity $R_2/R_1$, a quantity which will be denoted as $\alpha$. Although $R_2$ is static, it may not be arbitrarily chosen because it must be of a sufficient resistance to ensure that diode $D_1$ is forward-biased. A current $I_{D1}$ through diode $D_1$ is an exponential function of the voltage $V_{BE1}$ as given by $$I_{D1} \approx I_S \exp(V_{BE1}/V_T) \quad \text{Eq. (3)}$$

where $I_S$ is the saturation current and $V_T$ is the thermal voltage. From equation (3), it can be shown that $I_{D1}$ is negligible until $V_{BE1}$ exceeds a cut-in voltage of approximately 0.5 to 0.7 volts. This apparent threshold results from the exponential relationship given in equation (3). Thus, $R_2$ must be of a sufficient value to raise $V_{BE1}$ to the cut-in voltage and will depend upon the value of the supply voltage VCC. Having determined a value for $R_2$, equation (2) may be used to determine a desired starting value for $\alpha$. From equation (2), it may be shown that the bracketed quantity is expected to equal the bandgap voltage for silicon when the PTAT and CTAT components are balanced. The bandgap voltage for silicon at room temperature is approximately 1.24 volts. From this voltage and given the value of $R_2$, which sets the value of $V_{BE1}$, an appropriate value for $\alpha$ may be chosen for which the output voltage $V_{out}$ is expected to be thermally stable as seen from equation (2).

Figure 3:
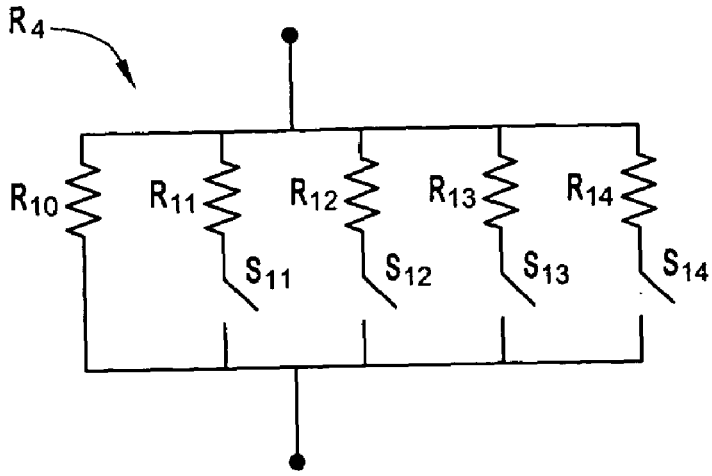
FIG. 3 is a schematic illustration of a first type of variable resistor to control the CTAT/PTAT balance for the bandgap reference of FIG. 2.

But as discussed earlier, process variations and modeling inaccuracies make predicting a thermally stable output voltage problematic. To accommodate such uncertainty, variable resistor $R_1$ may be implemented as seen in FIG. 3. The resistance $R_1$ includes a fixed resistance $R_{10}$ and a plurality of resistances such as resistances $R_{11}$ through $R_{14}$ that may be selectively coupled in parallel with resistance $R_{10}$ depending upon the activation of a plurality of corresponding switches $S_{11}$ through $S_{14}$. Each resistor may be a discrete device or formed in an N-well or P-well of a semiconductor substrate as is known in the art. In addition, each switch may comprise a transistor such as a MOSFET. Alternatively, each switch may comprise a laser-fusible switch. The value of $R_{10}$ may be chosen as follows. As discussed above, bandgap reference 200 may be designed using an appropriate value for $\alpha$ for which a thermally stable output voltage is expected, a value which may be denoted as $\alpha_0$. For example, in one embodiment, stable operation would be expected for $\alpha_0$=10. Depending upon the margin of safety desired, $R_1$ may be varied across a certain dynamic range to give a corresponding dynamic range to $\alpha$. Should a 20% safety margin be desired about $\alpha_0$, the dynamic range for a would thus range from a minimum value of 8 to a maximum value of 12. Depending upon the number of resistances that may be selectively coupled in parallel with $R_{10}$, the dynamic range may be sampled more finely.

The sampling of the dynamic range for $\alpha$ depends upon the expected probability distribution for this value. It has been found that, in general, this distribution is reasonably evenly distributed. As such, a uniform spacing between sampling points of $\alpha$ would provide the most accurate matching of the sampled $\alpha$ to the actual value required to provide the best temperature compensation. Were the samples perfectly evenly spaced throughout the sampling space, they would define a linear slope from the minimum value of $\alpha$ to the maximum value. In turn, because the value of $\alpha$ is inversely proportional to the resistance of variable resistor $R_1$, the conductance of variable resistor $R_1$ should span linearly the corresponding range of conductances. With respect to the embodiment of $R_1$ shown in FIG. 3, there are four selectable resistances $R_{11}$ through $R_{14}$, thereby providing $2^4$=16 sample points in the conductance dynamic range.

The minimum conductance value is determined by the conductance of resistor $R_{10}$. In this case, all switches $S_{11}$ through $S_{14}$ would be open. As additional resistors are coupled in parallel through operation of switches $S_{11}$ through $S_{14}$, the resulting conductance for the combination increases. By providing a binary progression to the resistances for resistors $R_{11}$ through $R_{14}$, the resulting conductance may be increased in equal increments.

The selection of values for resistances $R_{11}$ through $R_{14}$ may now be described where the sampling space for a extends from a minimum value of 8 to a maximum value of 12. In this example, all resistances are given as multiples of 3KΩ. Should $R_2$ be a 10 for such a scaling (actual value of 30KΩ), to achieve a minimum value for α of 8 requires $R_{10}$ be 1.25. With 16 sample points including both the maximum and minimum values, α should be selectively adjustable in 0.27 unit increments. A binary progression to approximate such a spacing gives $R_{11}$=4.5, $R_{12}$=9, $R_{13}$=18, and $R_{14}$=36. The following table 1 demonstrates the resulting switch positions (zero representing OFF, and 1 representing ON), the resistance of $R_1$, and α.

TABLE 1

| $sw_{11}$ | $sw_{12}$ | $sw_{13}$ | $sw_{14}$ | $R_1$ | α |
|---|---|---|---|---|---|
| 0 | 0 | 0 | 0 | 1.25 | 8 |
| 0 | 0 | 0 | 1 | 1.208129 | 8.277264 |
| 0 | 0 | 1 | 0 | 1.169111 | 8.553506 |
| 0 | 0 | 1 | 1 | 1.132404 | 8.83077 |
| 0 | 1 | 0 | 0 | 1.098546 | 9.102941 |
| 0 | 1 | 0 | 1 | 1.066075 | 9.380206 |
| 0 | 1 | 1 | 0 | 1.035578 | 9.656447 |
| 0 | 1 | 1 | 1 | 1.006673 | 9.933711 |
| 1 | 0 | 0 | 0 | 0.981375 | 10.18978 |
| 1 | 0 | 0 | 1 | 0.955379 | 10.46705 |
| 1 | 0 | 1 | 0 | 0.930814 | 10.74329 |
| 1 | 0 | 1 | 1 | 0.907396 | 11.02055 |
| 1 | 1 | 0 | 0 | 0.885526 | 11.29272 |
| 1 | 1 | 0 | 1 | 0.864305 | 11.56999 |
| 1 | 1 | 1 | 0 | 0.844151 | 11.84623 |
| 1 | 1 | 1 | 1 | 0.824845 | 12.12349 |

Figure 4:
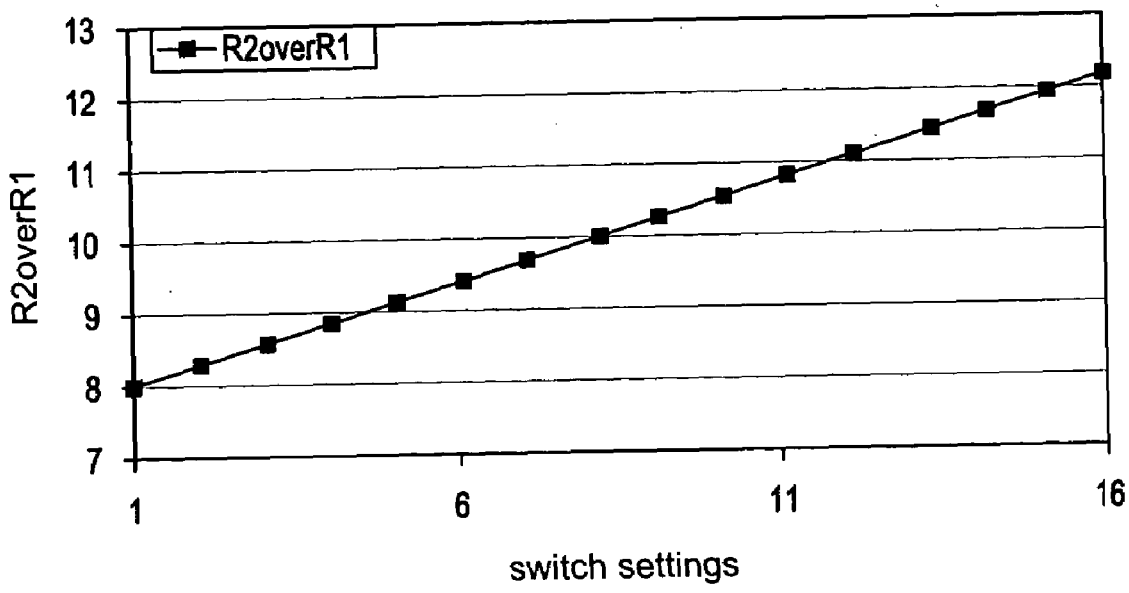
FIG. 4 is a plot of a resistance ratio within the bandgap reference of FIG. 2 as a function of switch settings within the variable resistor shown in FIG. 3.

FIG. 4 is a plot of the α values for the 16 switch positions. It will be appreciated that other sample spacing may be used depending upon the expected probability distribution for α.

Note that the variation of resistance $R_1$ will change the common-mode input voltage (voltages at nodes A and B) for differential amplifier 205. Thus, currents $I_1$ through $I_3$ will change as well. In turn, this affects the voltages $V_{BE1}$ and $V_{BE2}$ across diodes $D_1$ and $D_2$, respectively. However, because diode current is an exponential function of the diode voltage as discussed with respect to equation (3), the change in diode voltages is relatively very small with respect to the change in diode current. Thus, the operating points for diodes $D_1$ and $D_2$ are not effectively changed, despite the variation of $R_1$.

Varying $R_4$ to Vary the Output Voltage

As seen from equation (3), $V_{out}$ is proportional to the resistance ratio $R_4/R_2$. It will be appreciated that variation of either $R_4$ or $R_2$ will affect the output voltage, $V_{out}$. But note that variation of $R_2$ will affect the PTAT/CTAT balance already discussed with respect to the variation of $R_1$. Thus, variation of $R_4$ alone avoids unnecessary complication. It will be appreciated, however, that variation of other resistors besides $R_1$ and $R_4$ is within the scope of the invention.

Figure 5A:
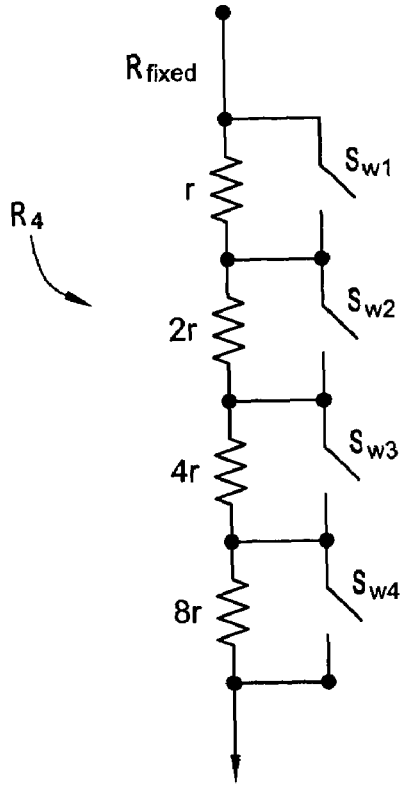
FIG. 5*a* is a schematic illustration of a second type of variable resistor to control the output voltage for the bandgap reference of FIG. 2.

Because the output voltage is directly proportional to the variable resistance $R_4$ (rather than inversely proportional), a combination of a fixed resistor that may be selectively combined in series with additional resistors achieves the greatest dynamic range for $V_{out}$ with the least amount of switches. For example, an embodiment of variable resistor $R_4$ as seen in FIG. 5*a* provides sixteen resistance values between a minimum value of $R_{fixed}$ and a maximum value of $R_{fixed}$+15R through operation of switches $S_{W1}$ through $S_{W4}$ that couple in parallel with corresponding resistors R through 8R. If a given switch is open, the corresponding resistor will couple in series with a fixed resistor $R_{fixed}$. However, if a given switch is closed, the corresponding resistor will not couple in series with fixed resistor $R_{fixed}$. For example, if all switches $S_{W1}$ through $S_{W4}$ are closed, the resulting resistance of variable resistor $R_4$ is $R_{fixed}$. If switch $S_{W1}$ is opened and the remaining switches kept closed, the resulting resistance of variable resistor $R_4$ is $R_{fixed}$+R. If switch $S_{W2}$ is opened and the remaining switches kept closed, the resulting resistance of variable resistor $R_4$ is $R_{fixed}$+2R. Through analogous operation of switches $S_{W1}$ through $S_{W4}$, the resulting resistance may be selectively increased in increments of R until the maximum resistance of $R_{fixed}$+15R is achieved. Such a linear progression of resistances assumes, however, that the ON resistance of switches $S_{W1}$ through $S_{W4}$ is zero. In reality, the ON resistance is finite should, for example, switches $S_{W1}$ through $S_{W4}$ be implemented using MOSFETs. To maintain approximately equal resistance increments, the ON resistance of switches $S_{W1}$ through $S_{W4}$ should be at least $1/10^{th}$ that of R. However, if the switches are implemented as MOSFETS, an inordinate amount of silicon must then be dedicated to their construction.

Figure 5B:
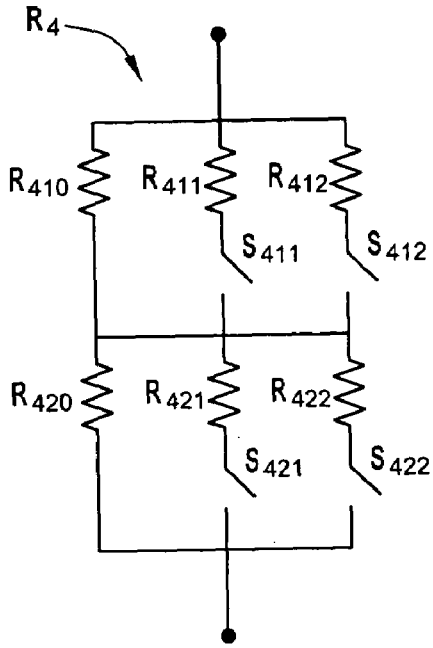
FIG. 5*b* is a schematic illustration of a third type of variable resistor to control the output voltage for the bandgap reference of FIG. 2.

Thus, an alternate embodiment for variable resistor R4 may be implemented as seen in FIG. 5*b* which does not require such a rigorous restriction on the ON resistances of the switches. As seen in FIG. 5*b*, variable resistance $R_4$ may comprise a series combination of two variable resistances. The first resistance is formed from a fixed resistor $R_{410}$ and a plurality of resistances such as resistances $R_{411}$ and $R_{412}$ that may be selectively coupled in parallel with resistance $R_{410}$ depending upon the activation of corresponding switches $S_{411}$ and $S_{412}$. Similarly, the second resistance is formed from a fixed resistor $R_{420}$ and a plurality of resistances such as resistances $R_{421}$ and $R_{422}$ that may be selectively coupled in parallel with resistance $R_{420}$ depending upon the activation of corresponding switches $S_{421}$ and $S_{422}$. Each resistor may be a discrete device or formed in an N-well or P-well of a semiconductor substrate as is known in the art. In addition, each switch may comprise a transistor such as a MOSFET. Alternatively, each switch may comprise a laser-fusible switch. It will be appreciated that the number of resistors that may be selectively combined in parallel is a design choice and, having formed the parallel combinations, the number of parallel combinations that may be serially coupled together depends upon the degree of precision needed for the output voltage variation and cost considerations. Clearly, keeping the number of resistor/switch combinations to a minimum achieves a simpler, less costly design.

As discussed earlier, the value of the bracketed quantity in equation (3) is substantially equal to the silicon bandgap voltage (1.24 volts) when the PTAT/CTAT components have been balanced. In turn, the output voltage will equal ($R_4/R_2$) times this bandgap voltage. The value of resistance $R_2$ is governed by the need to keep diode $D_1$ forward-biased during operation. For example, in one embodiment, a value of 30K ohms was found sufficient. Given a value for $R_2$ and the desired output voltage, the desired value for the $R_4$ resistance may be determined. This desired value for $R_4$ may be denoted as $R_{40}$. Because of process variations and other affects, the actual output voltage may not be what one designed for. Thus, the variability of $R_4$ should allow for some dynamic range about the value $R_{40}$, for example +/−20% of this value. As discussed previously with respect to α, the sampling of the dynamic range for $R_4$ depends upon the expected probability distribution for this value. Assuming a flat probability distribution, a uniform spacing between sampling points in this dynamic range would provide the most accurate matching of the sampled $R_4$ resistance to the value required to provide the precise output voltage desired. In other words, it would be desirable to have the resistance $R_4$ be variable between a minimum and maximum value in equal-sized increments such that a linear variation is achieved. Depending upon the switch settings, $R_4$ would then vary in a linear fashion between its minimum and maximum values.

With respect to the $R_4$ embodiment shown in FIG. 5*b*, a linear slope cannot be achieved, however, because of the parallel resistance combinations. A number of numerical techniques such as a least mean squares approach may be used to minimize the error between realizable values for the selectable resistances and the resulting spacing between sample points. For example, suppose it is desired to have $V_{out}$ equal 300 millivolts for an embodiment wherein the resistance of $R_2$ is 30KΩ. The implementation of a least mean squares optimization with respect to resistances $R_{140}$ through $R_{422}$ of FIG. 5 may now be described. Because there are four switches, $R_4$ may be varied through sixteen different resistances. In this example, all resistances are given as multiples of 3KΩ, where $R_{411}$=5.75, $R_{412}$=18, $R_{421}$=4.5, and $R_{422}$=25. The following table 2 demonstrates the resulting switch positions (zero representing OFF, and 1 representing ON), the resistance for $R_4$, and the ratio $R_4/R_2$.

TABLE 2

| $sw_{411}$ | $sw_{412}$ | $sw_{421}$ | $sw_{422}$ | $R_4$ | $R_4/R_2$ |
|---|---|---|---|---|---|
| 1 | 1 | 1 | 1 | 2.080 | 0.208 |
| 1 | 0 | 1 | 1 | 2.132 | 0.213 |
| 1 | 1 | 1 | 0 | 2.134 | 0.213 |
| 1 | 0 | 1 | 0 | 2.186 | 0.219 |
| 0 | 1 | 1 | 1 | 2.262 | 0.226 |
| 0 | 1 | 1 | 0 | 2.316 | 0.232 |
| 0 | 0 | 1 | 1 | 2.337 | 0.234 |
| 0 | 0 | 1 | 0 | 2.391 | 0.239 |
| 1 | 1 | 0 | 1 | 2.457 | 0.246 |
| 1 | 0 | 0 | 1 | 2.509 | 0.251 |
| 1 | 1 | 0 | 0 | 2.554 | 0.255 |
| 1 | 0 | 0 | 0 | 2.606 | 0.261 |
| 0 | 1 | 0 | 1 | 2.639 | 0.264 |
| 0 | 0 | 0 | 1 | 2.714 | 0.271 |
| 0 | 1 | 0 | 0 | 2.736 | 0.274 |
| 0 | 0 | 0 | 0 | 2.811 | 0.281 |

Figure 6:
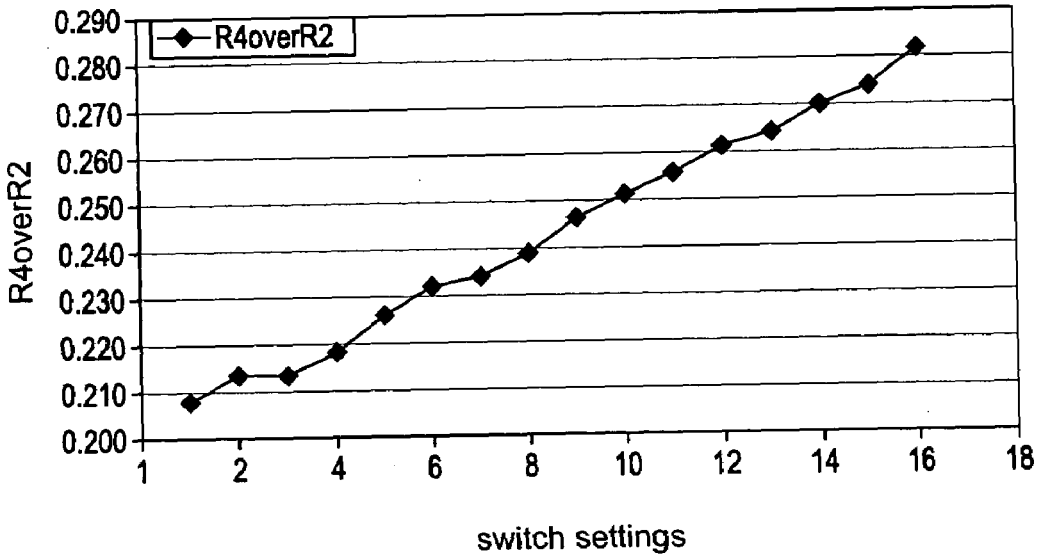
FIG. 6 is a plot of a resistance ratio within the bandgap reference of FIG. 2 as a function of switch settings within the variable resistance shown in FIG. 5*b*.

FIG. 6 is a plot of the $R_4/R_2$ ratio for the 16 switch positions. It will be appreciated that other sample spacing may be used depending upon the expected probability distribution for $R_{40}$.

Note that by including just 4 switches each for variable resistors $R_1$ and $R_4$, both the PTAT/CTAT balance and the output voltage balance may be varied through substantially equal increments over a broad dynamic range. In this fashion, during manufacture of bandgap references 200 from the same silicon ingot, a certain number of samples may be tested to judge their temperature compensation across the expected operating temperature range. If necessary, the switch positions for $R_1$ may be adjusted to achieve a balance between the PTAT and CTAT voltage contributions. In addition, the switch positions for $R_4$ may be adjusted to bring the output voltage to a desired level for the median temperature in the operating range. The remaining devices may be assumed to have similar properties such that the switches for resistors $R_1$ and $R_4$ would be set accordingly.

Figure 7:
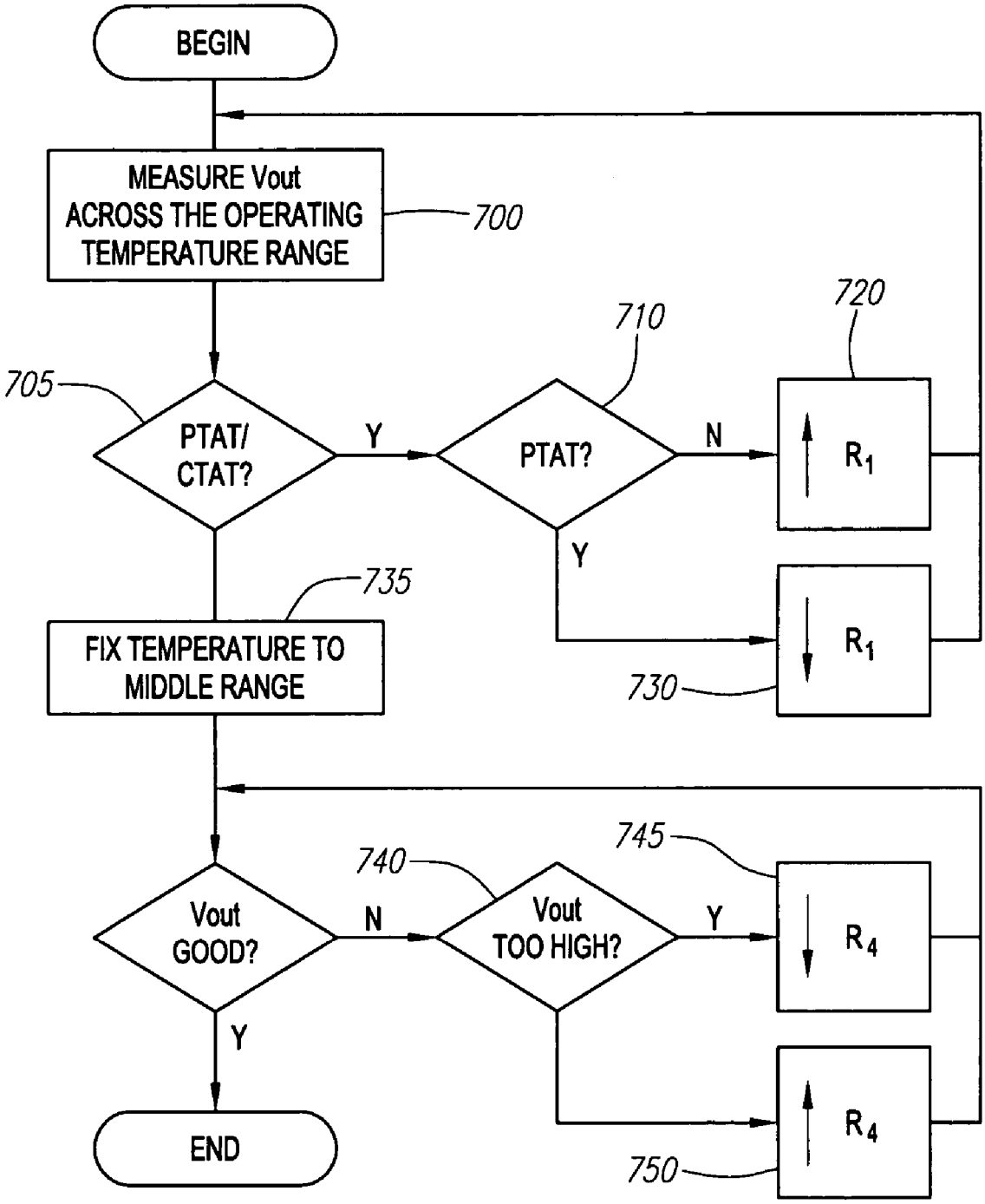
FIG. 7 is a flowchart for a temperature compensation and output voltage compensation procedure for the bandgap reference of FIG. 2.

This procedure may be summarized with respect to the flowchart shown in FIG. 7. At step 700, $V_{out}$ is measured across the expected temperature operating range. At step 705, the voltage variation for $V_{out}$ is examined to determine if the PTAT and CTAT voltage contributions are in balance. Because a perfect balance is unobtainable, such a test would determine whether $V_{out}$ remained within an acceptable tolerance across the temperature range. Should the variation be greater than an acceptable tolerance, the determination of whether the variation is a PTAT or CTAT variation occurs in step 710. In other words, if the output voltage $V_{out}$ increases with respect to temperature, a PTAT dependency is shown. Alternatively, if the output voltage $V_{out}$ decreases with respect to temperature, a CTAT dependency is shown. The goal, of course, is that $V_{out}$ possesses neither a PTAT nor a CTAT dependency through proper variation of $R_1$. Should the variation be PTAT, $R_1$ is decreased one increment in step 720. Otherwise, $R_1$ is increased one increment in step 730. Upon appropriate adjustment of $R_1$, $V_{out}$ will be independent with respect to changes in temperature across the desired operating temperature range. Having achieved temperature compensation, the output voltage is tested at the middle of the temperature range in step 735. Alternatively, the output voltage may be tested at the most probable operating temperature in the range, should this differ from the middle temperature. If $V_{out}$ is outside the acceptable operating tolerance, a determination is made whether it above this acceptable operating tolerance at step 740. If yes, variable resistance $R_4$ is decreased one increment at step 745. Otherwise, variable resistance $R_4$ is increased one increment at step 750. At this point, both $R_1$ and $R_4$ will have been configured for optimal performance. It will be appreciated that the configuration process described with respect to FIG. 7 is subject to many variations. For example, rather than increment the resistances in single increments, a more advanced approach could initially increment in multiple increments to achieve a faster convergence.

Although the invention has been described with respect to particular embodiments, this description is only an example of the invention's application and should not be taken as a limitation. Consequently, the scope of the invention is set forth in the following claims.

What is claimed is:

1. A bandgap reference, comprising:

a first current source configured to provide a current that is proportional to the sum of a first voltage having a positive-to-absolute-temperature (PTAT) temperature dependency and a second voltage having a complementary-to-absolute-temperature (CTAT) dependency; and a a first variable resistor including a first resistor and a plurality of second resistors, wherein each of the second resistors is adapted to be selectively combined in parallel with the first resistor such that a conductance of the first variable resistor equals a sum of a conductance for the first resistor and a combined conductance for the selected second resistors, and wherein the second voltage is inversely proportional to the resistance of the first variable resistor.

2. The bandgap reference of claim 1, wherein each of the second resistors couples to a corresponding switch such that if the switch corresponding to a given second resistor is ON, the given second resistor is coupled in parallel with the first resistor.

3. The bandgap reference of claim 2, further comprising:

a second current source;

a third resistor; and a first diode coupled in parallel with the third resistor, wherein the second current source drives the parallel-coupled third resistor and the first diode to generate the first voltage, and wherein the second voltage is proportional to the ratio of the resistance of the third resistor to the resistance of the first variable resistor.

4. The bandgap reference of claim 3, wherein the first variable resistor is adapted such that the voltage ratio is discretely variable in substantially equal increments from a minimum voltage ratio value to a maximum voltage ratio value.

5. The bandgap reference of claim 4, further comprising a second variable resistor configured to be driven by the first current source to produce a bandgap reference output voltage tat is proportional to a ratio of the resistance of the second variable resistor to the resistance of the third resistor.

6. The bandgap reference of claim 5, wherein the second variable resistor includes:

a fourth resistor in series with a fifth resistor;

a plurality of sixth resistors, wherein each of the sixth resistors is adapted to be selectively combined in parallel with the fourth resistor; and a plurality of seventh resistors, wherein each of the seventh resistors is adapted to be selectively combined in parallel with the fifth resistor.

7. The bandgap reference of claim 6, wherein the second variable resistor is adapted such that the ratio of the resistance of the second variable resistor to the resistance of the third resistor is discretely variable in substantially equal increments from a minimum voltage ratio value to a maximum voltage ratio value.

8. The bandgap reference of claim 7, wherein each of the sixth resistors couples to a corresponding switch such that if the switch corresponding to a given sixth resistor is ON, the given sixth resistor is coupled in parallel with the fourth resistor.

9. The bandgap reference of claim 7, wherein each of the seventh resistors couples to a corresponding switch such that if the switch corresponding to a given seventh resistor is ON, the given seventh resistor is coupled in parallel with the fifth resistor.

10. A method comprising:

providing a bandgap reference, wherein the bandgap reference comprises a first variable resistor including a first resistor and a plurality of second resistors, wherein each of the second resistors is adapted to be selectively coupled in parallel with the first resistor such that resistance of the first variable resistor is variable in discrete increments depending upon whether a given second resistor is selected to be coupled in parallel with the first resistor, and wherein a contribution from a voltage component having a positive-to-absolute-temperature (PTAT) temperature dependency to an output voltage of the bandgap reference is inversely proportional to the resistance of the first variable resistor; and assigning resistances to the first and second resistors such that the discrete increments for the resistance of the first variable resistor are substantially equal.

11. The method of claim 10, wherein the resistances of the second resistors are assigned according to a binary progression.

12. The method of claim 11, further comprising:

varying the resistance of the first variable resistor according to the discrete increments such that the output voltage is thermally stable.

13. A bandgap reference, comprising:

a first current source configured to provide a current that is proportional to the sum of a first voltage having a positive-to-absolute-temperature (PTAT) temperature dependency and a second voltage having a complementary-to-absolute-temperature (CTAT) dependency;

a differential amplifier responsive to the difference between the first and second voltages, the differential amplifier controlling the current provided by the first current source; and a first variable resistor including a first resistor and a plurality of second resistors, wherein each of the second resistors is adapted to be selectively combined in parallel with the first resistor such that a conductance of the first variable resistor equals a sum of a conductance for the first resistor and a combined conductance for the selected second resistors, and wherein the second voltage is inversely proportional to resistance of the variable resistor.

14. The bandgap reference of claim 13, wherein each of the second resistors couples to a corresponding switch such that if the switch corresponding to a given second resistor is ON, the given second resistor is coupled in parallel with the first resistor.

15. The bandgap reference of claim 14, further comprising:

a second current source having a current also controlled by the differential amplifier;

a third resistor;

and a first diode coupled in parallel with the third resistor, wherein the second current source drives the parallel-coupled third resistor and the first diode to generate the first voltage, and wherein the second voltage is proportional to a ratio of the resistance of the third resistor to the resistance of the first variable resistor.

16. The bandgap reference of claim 15, wherein the first variable resistor is adapted such that the ratio is discretely variable in substantially equal increments from a minimum voltage ratio value to a maximum voltage ratio value.

17. The bandgap reference of claim 16, further comprising a second variable resistor configured to be driven by the first current source to produce a bandgap reference output voltage that is proportional to a ratio of the resistance of the second variable resistor to the resistance of the third resistor.

* * * * *